US010126004B2

(12) United States Patent
Kim

(10) Patent No.: US 10,126,004 B2
(45) Date of Patent: Nov. 13, 2018

(54) METHOD OF RECYCLING WASTE HEAT FROM HEAT GENERATING FACILITY

(71) Applicant: Gun Tag Kim, Yongin-si (KR)

(72) Inventor: Gun Tag Kim, Yongin-si (KR)

( * ) Notice: Subject to any disclaimer, the term of this patent is extended or adjusted under 35 U.S.C. 154(b) by 172 days.

(21) Appl. No.: 15/111,108

(22) PCT Filed: Jul. 7, 2015

(86) PCT No.: PCT/KR2015/007015
§ 371 (c)(1),
(2) Date: Jul. 12, 2016

(87) PCT Pub. No.: WO2016/006916
PCT Pub. Date: Jan. 14, 2016

(65) Prior Publication Data

US 2016/0327288 A1 Nov. 10, 2016

(30) Foreign Application Priority Data

Jul. 8, 2014 (KR) ..... 10-2014-0085267

(51) Int. Cl.
*F24F 12/00* (2006.01)
*F24F 3/14* (2006.01)
*F01K 5/00* (2006.01)

(52) U.S. Cl.
CPC ..... *F24F 3/14* (2013.01); *F01K 5/00* (2013.01); *F24F 12/00* (2013.01); *F24F 12/003* (2013.01)

(58) Field of Classification Search
CPC ..... F24F 3/14; F24F 12/00; F24F 12/003
USPC ..... 165/60
See application file for complete search history.

(56) References Cited

U.S. PATENT DOCUMENTS 4,284,129 A * 8/1981 Rogalski ..... F24D 5/04 165/50
7,698,906 B2 * 4/2010 Jarvis ..... F24F 5/0035 165/4

FOREIGN PATENT DOCUMENTS

| | | | |
|---|---|---|---|
| JP | 2012127564 | A | 7/2012 |
| JP | 2014059068 | A | 4/2014 |
| KR | 1020110126960 | A | 11/2011 |
| KR | 101254935 | B1 | 4/2013 |

OTHER PUBLICATIONS

PCT International Search Report of PCT/KR2015/007015.
Written Opinion of International Searching Authority of PCT/KR2015/007015.

* cited by examiner

*Primary Examiner* — Jianying Atkisson
*Assistant Examiner* — Joel Attey
(74) *Attorney, Agent, or Firm* — Paratus Law Group, PLLC

(57) ABSTRACT

The present disclosure provides: a method for recycling waste-heat from a heat-dissipation facility, the method comprising: (a) collecting hot waste air generated in the heat-dissipation facility; (b) changing the hot air to cool air to change cool water to hot water; (c) feeding the cool air to the heat-dissipation facility to cool air in the heat-dissipation facility; and (d) increasing a humidity in the heat-dissipation facility using the hot water.

9 Claims, 4 Drawing Sheets

METHOD OF RECYCLING WASTE HEAT FROM HEAT GENERATING FACILITY

CROSS-REFERENCE TO PRIOR APPLICATIONS

This application is a National Stage Patent Application of PCT International Patent Application No. PCT/KR2015/007015 (filed Jul. 7, 2015) under 35 U.S.C. § 371, which claims the benefit of foreign priority of Korean Patent Application No. 10-2014-0085267 (filed Jul. 8, 2014), the subject matter of which is hereby incorporated by reference in its entirety.

BACKGROUND

Field of the Present Disclosure

The present disclosure relates to a waste-heat recycling method in a heat-dissipation facility. More particularly, the present disclosure relates to a waste-heat recycling method in a heat-dissipation facility wherein a waste heat from the heat-dissipation facility is recycled to humidify and/or re-heat air in the heat-dissipation facility for a constant temperature and humidity.

Discussion of the Related Art

A data center means a facility on which computer systems, telecommunications equipment, storages, etc. are installed. This data center is a space to handle tasks such as Internet browsing, email and online shopping.

The data center has a redundant power supply apparatus and data communications equipment in order to cope with an emergency event because when the power supply is interrupted, its function is being paralyzed. The data center sever emits a heat. Thus, the data center is equipped with air conditioning and fire facilities and security devices.

The data center began to receive attention from the wide Internet spread. To access the Internet quickly and conveniently by the company, the company needs to have indicated facilities. A large company has large-scale facilities called as Internet data center (IDC). However, a small company commits its equipment storage and management to a company with a professional facility for reducing costs. Internet data center is called as a sever hotel or rent sever apartment because it takes and manages the Internet server (equipment) on behalf of the company of the server.

The data center building was constructed in the normal football stadium area (10000 $m^2$ in size). The data center server includes a server place (information processing area), a network operations center (NOC) for 24-hour management, and cooling facilities and power supply facilities (utility areas).

The server equipment is essential to be maintained at constant temperature and humidity levels since it is sensitive to temperature and humidity. The appropriate temperature is 16 to 24° C., and the humidity should be maintained at 40 to 55%. Further, it requires a safety facilities and the security device against disasters such as earthquakes and floods. According to TIA-942: the data center standards overview of Telecommunications Industry Association, the data center is classified into four grades, depending on the installation conditions. For the highest grade (Tier Level 4), the data center may require a cooling equipment, and a dual power apparatus.

On the other hand, the data center for cloud services may be referred to as the cloud data center (CDC). However, with the technological development, these terms DC, IDC, CDC have been collectively called as a data center.

As the data center inevitably grows in a size and number in social and technical aspects, the enormous energy power is consumed by the data center. The power consumption of the data center is different for each country, and, accounts for 0.5% of the country(Korea)'s total electricity consumption. Its percentage may be likely to increase. ½ of the total electricity consumption by the data center is required for the pure data processing, and the other half is required for maintaining the data center at optimum constant temperature and humidity. For energy-efficiency, a low power constant temperature and humidity equipment and low power consumption processor are needed.

SUMMARY

Thus, the present disclosure is to provide a waste-heat recycling method in a heat-dissipation facility wherein a waste heat from the heat-dissipation facility is recycled to humidify and/or re-heat air in the heat-dissipation facility for a constant temperature and humidity.

In one aspect, the present disclosure provides:

a method for recycling waste-heat from a heat-dissipation facility, the method comprising: (a) collecting hot waste air generated in the heat-dissipation facility;

(b) changing the hot air to cool air to change cool water to hot water;

(c) feeding the cool air to the heat-dissipation facility to cool air in the heat-dissipation facility; and (d) increasing a humidity in the heat-dissipation facility using the hot water.

In one embodiment, the (a) to (c) operations are executed using an air to water heat pump.

In one embodiment, the (d) operation includes: evaporating the hot water to form a hot vapor; and feeding the hot vapor to the heat-dissipation facility.

In one embodiment, the (d) operation is executed using a humidifying chamber having a fan.

In one embodiment, the (d) operation includes: evaporating a further cool water using the hot water as a heat source to form a hot vapor; and feeding the hot vapor to the heat-dissipation facility.

In one embodiment, the (d) operation is executed using a humidifier having a fan.

In one embodiment, the method further comprises: (e) re-heating air in in the heat-dissipation facility using the hot water.

In one embodiment, the method further comprises: (f) removing moisture from humid air in the heat-dissipation facility to lower a humidity in the heat-dissipation facility, wherein the (e) operation follows the (f) operation.

In one embodiment, he (e) operation includes: transferring a heat from the hot water as a heat source to super-cool air to form non-super cool air, wherein the super-cool air is acquired from the heat-dissipation facility after the (f) operation; and feeding the non-super cool air to the heat-dissipation facility.

In one embodiment, the (a) to (f) operations are executed using individual apparatuses; or at least two of the (a) to (f) operations are executed in a single apparatus.

In one embodiment, the (a) to (f) operations are not necessarily executed in this order or may be executed in a difference sequence or at least two of the (a) to (f) operations are executed concurrently.

In another aspect, the present disclosure provides:

a method for recycling waste-heat from a heat-dissipation facility, the method comprising; collecting hot waste air generated in the heat-dissipation facility;

changing the hot air to cool air to change cool water to hot water;

feeding the cool air to the heat-dissipation facility to cool air in the heat-dissipation facility;

removing moisture from humid air in the heat-dissipation facility to lower a humidity in the heat-dissipation facility, re-heating air in in the heat-dissipation facility using the hot water.

In one embodiment, the heat-dissipation facility is a data center, a semiconductor manufacturing factory, an electronics or electrics manufacturing factory, a precision machining factory, a secondary batter manufacturing factory, a secondary batter assembly factory, or a laboratory or hospital with measurement and/or analysis instruments.

Using the present waste-heat recycling method in the heat-dissipation facility, a waste heat from the heat-dissipation facility is recycled to humidify and/or re-heat air in the heat-dissipation facility for a constant temperature and humidity. Thus, cooling, humidifying and/or re-heating energy to the heat-dissipation facility for a constant temperature and humidity of the heat-dissipation facility may be saved. This may lead to a power consumption reduction and reduction of carbon footprint.

BRIEF DESCRIPTIONS OF THE DRAWINGS

DETAILED DESCRIPTIONS

A waste-heat recycling method in the heat-dissipation facility will be described in details with reference to various embodiments of the present disclosure.

Hereinafter, the heat-dissipation facility may refer to a data center, a semiconductor manufacturing factory, an electronics or electrics manufacturing factory, a precision machining factory, a secondary batter manufacturing factory, a secondary batter assembly factory, or a laboratory or hospital with measurement and/or analysis instruments. The present disclosure is not limited thereto.

In FIG. 1 to FIG. 4, a data center 100 may mainly refer to an information processing area. However, based on a context, the data center 100 may refer to a utility area.

Figure 1:
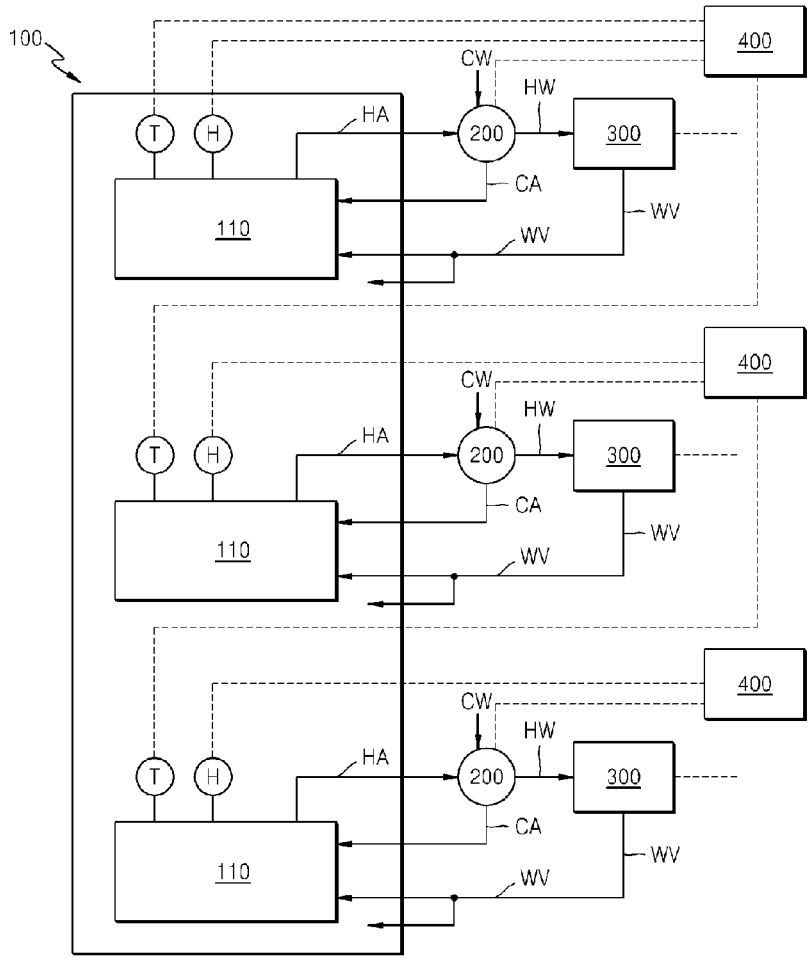
FIG. 1 shows a process circuit diagram for describing a waste-heat recycling method in a heat-dissipation facility in accordance with a first embodiment of the present disclosure.

FIG. 1 shows a process circuit diagram for describing a waste-heat recycling method in a heat-dissipation facility in accordance with a first embodiment of the present disclosure.

Referring to FIG. 1, plural server rack server racks 110 in the data center 100 dissipate a hot air HA including waste-heats. For the sake of convenience of illustration, in FIG. 1, three server racks 110 are shown. The present disclosure is not limited thereto. More or less numbers of the server racks 110 may be considered.

Each hot air HA from each server rack 110 may be fed to each air to water heat pump 200 to transfer a heat to a refrigerant in each air to water heat pump 200 to evaporate the refrigerant. Thus, the hot air may be changed to a cool air CA. At the same time, cool water CW fed to the air to water heat pump 200 may be changed to hot water HW via a heat from the evaporated refrigerant. The hot water HW may have a temperature of approximately 50° C. to 90° C., specifically, approximately 60° C.

The air to water heat pump 200 may include following components (not shown): an evaporator, an evaporator coil, a hot air HA inlet, a refrigerant (for example, R-22. R-123. R134a), a compressor, a condenser, an expansion valve, a fan and a cool air outlet (Refer to http://www.heat-pump-industry.info/basic-knowledge-of-air-water-heat-pump-s.html). The air to water heat pump 200 may have a following operational procedure: (i) the fan of the air to water heat pump 200 may work to allow the hot air HA from the data center 100 to be absorbed into the air to water heat pump 200; (ii) the evaporator may absorb a heat from the hot air HA; (iii) the absorbed heat allow an evaporation of the refrigerant; (iv) the heated refrigerant gas flows into the compressor where the refrigerant gas may be compressed into a gas with a high-temperature and high-pressure; (v) the gas with the high-temperature and high-pressure flows into the condenser where the gas may transfer a heat to cool water CW fed to the condenser, and, thus, the gas may be changed to a liquid with a low-temperature and high-pressure and, as the same time, the cool water CW may be changed into hot water HW; (vi) the hot water HW is discharged out of the condenser; (vii) the liquid with the low-temperature and high-pressure flows into the expansion valve to allow the liquid to be changed into a liquid with the low-temperature and low-pressure; and (viii) the liquid with the low-temperature and low-pressure flows into the evaporator where the liquid may absorb the heat from new hot air HA. The present disclosure is not limited thereto. In place of the air to water heat pump 200, an apparatus having a similar or identical function to that of the air to water heat pump 200 may be considered.

The cool air CA may be supplied to the data center 100 to cool the server rack 110, and, at the same time, the hot water HW may be fed to a humidifying chamber 300 with a fan (not shown) to allow evaporation of the hot water HW therein to form a hot vapor WV. Thereafter, the hot vapor WV may be fed to the data center 100 to humidify ambient air around and/or within the server rack 110.

As used herein, the server rack 110 may refer to a server computer which is disposed on a framework type rack having layered shelves to support hardware pieces or different server computers.

The humidifying chamber 300 may or may not include a heating apparatus (not shown). Specifically, when the hot water HW has a high temperature sufficient to evaporate naturally, the humidifying chamber 300 may not require the heating apparatus, or may not activate the heating apparatus if present. Even when the humidifying chamber 300 may have and thus activate the heating apparatus, the heating apparatus may advantageously consume a less power for evaporation of the hot water HW because the hot water HW has the temperature of 50 to 90° C. considerably higher than a reference temperature in the data center 100, for example, 16 to 24° C. This may lead to energy save.

In the process of FIG. 1, the presence of the humidifying chamber 300 may remove a need for a separate humidifier in the data center 100. This may lead to a cost save for the humidifier installation and maintenance.

Further, the air to water heat pump 200 and the humidifying chamber 300 may be individual. Alternatively, the air to water heat pump 200 and the humidifying chamber 300 may be integrated into a single apparatus.

A pumping speed of the hot water from the air to water heat pump 200 and a blowing speed of the humidifying chamber 300 may be controlled by a controller 400. Specifically, adjacent to the server rack 110, a temperature sensor T and a humidity sensor H are disposed to measure a temperature and humidity thereat to and then send the temperature and humidity data to the controller 400. The controller 400 may be configured to compare the measured temperature and humidity data with target temperature and humidity values pre-stored in the controller 400 and thus to control the pumping speed of the hot water from the air to water heat pump 200 and the blowing speed of the humidifying chamber 300 to reduce a difference between the measured and target temperature and humidity.

Although in FIG. 1, a single server rack 110 corresponds to a single air to water heat pump 200, a single humidifying chamber 300 and a single controller 400, the present disclosure is not limited thereto. A relationship between the numbers of the air to water heat pumps 200, humidifying chambers 300 and controllers 400 and the number of server racks 110 may vary based on the capacity of the air to water heat pumps 200, and humidifying chambers 300 and the heat dissipation of the server rack 110.

Figure 3:
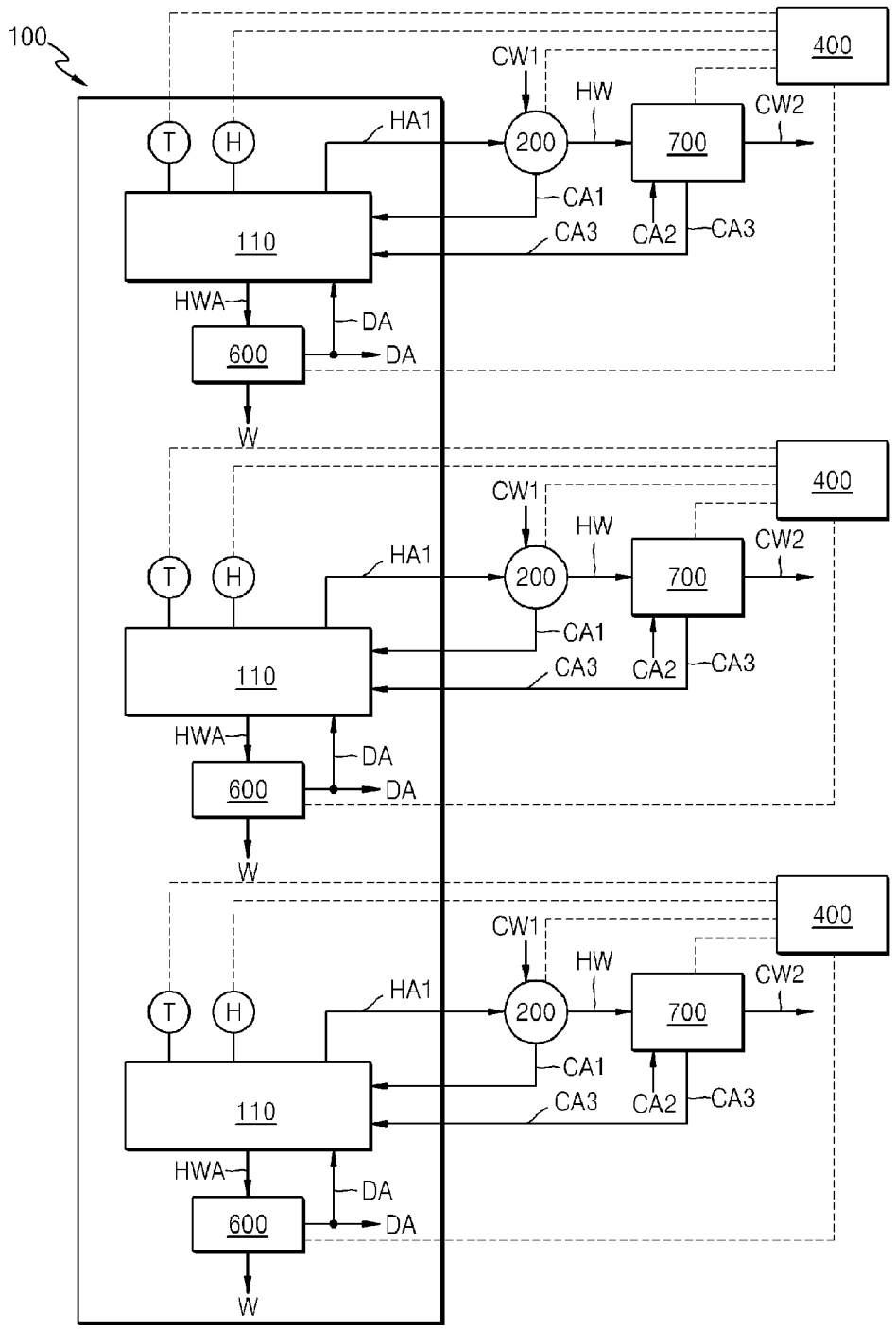
FIG. 3 shows a process circuit diagram for describing a waste-heat recycling method in a heat-dissipation facility in accordance with a third embodiment of the present disclosure.

Further, although in the process of FIG. 1, a dehumidifier is not present, the present disclosure is not limited thereto. A dehumidifier like a dehumidifier 600 as shown in FIG. 3 may be added into the process of FIG. 1.

Figure 2:
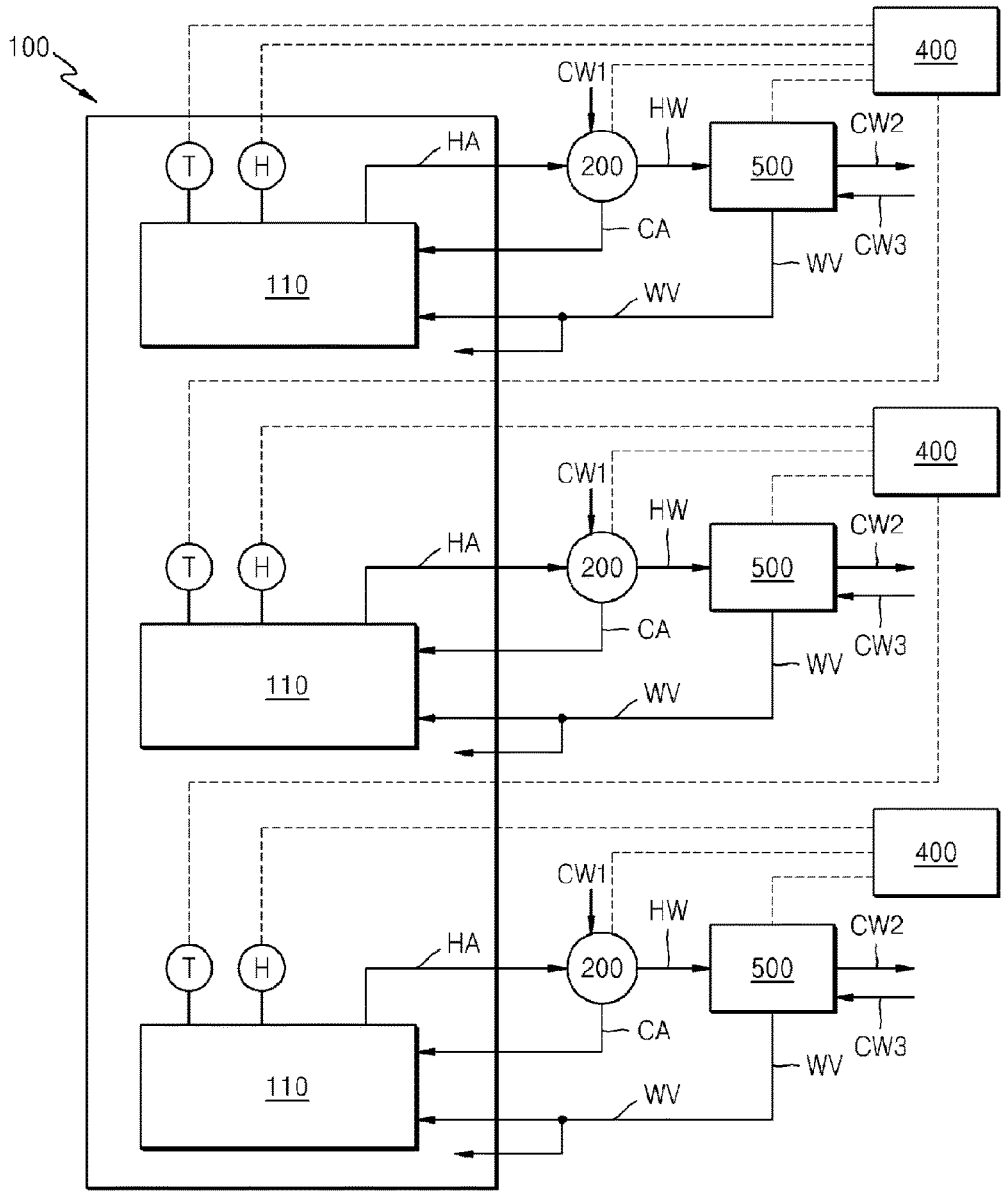
FIG. 2 shows a process circuit diagram for describing a waste-heat recycling method in a heat-dissipation facility in accordance with a second embodiment of the present disclosure.

FIG. 2 shows a process circuit diagram for describing a waste-heat recycling method in a heat-dissipation facility in accordance with a second embodiment of the present disclosure.

The waste-heat recycling method in a heat-dissipation facility in accordance with the second embodiment of the present disclosure may differ from the waste-heat recycling method in a heat-dissipation facility in accordance with the first embodiment of the present disclosure in that in place of the humidifying chamber 300, a humidifier 500 is replaced. The server rack 110, the air to water heat pump 200 and the controller 400 may have the same configurations between the first and second embodiments.

As described above, in FIG. 1, the humidifying chamber 300 may evaporate the hot water HW discharged from the air to water heat pump 200 naturally or using the heating apparatus, to emit the hot vapor WV to humidify the data center 100. In an alternative, in FIG. 2, the humidifier 500 may use the hot water HW discharged from the air to water heat pump 200 as a heat source to evaporate a further cool water CW3 fed thereto to be changed to a hot vapor WV to humidify the data center 100. Thus, the hot water HW from the air to water heat pump 200 may transfer the heat to the further cool water CW3 and then be changed to a cool water CW2 to be discharged out of the humidifier 500.

The further cool water CW3 may be purified water, for example, deionized water or desalted water.

The humidifier 500 may or not have a heating apparatus (not shown). Specifically, when the further cool water CW3 is evaporated sufficiently only using the hot water HW as a heat source, the humidifier 500 may not have the heating apparatus, or may not activate the heating apparatus if any. Even when the humidifier 500 has and activate the heating apparatus, the heating apparatus may advantageously consume a less power for evaporation of the further cool water CW3 because the hot water HW has the temperature of 50 to 90° C. considerably higher than a reference temperature in the data center 100, for example, 16 to 24° C. This may lead to energy save.

In the process of FIG. 2, the humidifier 500 may use the hot water HW as a partial heat source to save the maintenance cost of the humidifier 500.

Further, the air to water heat pump 200 and the humidifier 500 may be individual. Alternatively, the air to water heat pump 200 and the humidifier 500 may be integrated into a single apparatus.

Further, although in the process of FIG. 2, a dehumidifier is not present, the present disclosure is not limited thereto. A dehumidifier like a dehumidifier 600 as shown in FIG. 3 may be added into the process of FIG. 2.

FIG. 3 shows a process circuit diagram for describing a waste-heat recycling method in a heat-dissipation facility in accordance with a third embodiment of the present disclosure.

The waste-heat recycling method in a heat-dissipation facility in accordance with the third embodiment of the present disclosure may differ from the waste-heat recycling method in a heat-dissipation facility in accordance with the first embodiment of the present disclosure in that in place of the humidifying chamber 300, a re-heater 700 is replaced, and, further, a dehumidifier 600 is added. The server rack 110, the air to water heat pump 200 and the controller 400 may have the same configurations between the first and second embodiments.

Referring to FIG. 3, plural server racks 110 in the data center 100 may dissipate the hot air HA1 containing a waste heat.

The hot air HA1 may be fed to the air to water heat pump 200 to transfer a heat to the cool water CW1 fed to the air to water heat pump 200. Thus, the hot air HA1 may be changed to the cool air CA1. At the same time, the cool water CW1 may receive the heat from the hot air HA1 to be changed to the hot water HW. The hot water HW may have a temperature of approximately 50° C. to 90° C., specifically, approximately 60° C.

The dehumidifier 600 may remove moisture W from the humid air HWA in the data center to reduce the humidity in the data center 100. At this time, the humid air HWA free of the moisture W may be changed to a dry air DA to be fed to the server rack 110 in the data center 100 or otherwise may be discharged out of the data center.

The dehumidifier 600 may include following components (not shown): an evaporator, a refrigerant (for example, R-22. R-123, R134a), a compressor, a condenser and a fan (Refer to http://navercast.naver.com/contents.nhn?rid=102&contents_id=3405). The dehumidifier 600 may operate as follows: (i) the fan of the dehumidifier 600 may be activated to allow the humid air HWA in the data center to be absorbed into the dehumidifier 600; (ii) the absorbed humid air HWA may flow into the evaporator, where a temperature of the humid air HWA may be lowered to a dew point, such that the hot vapor therein may be changed to a moisture W which is removed from the dehumidifier 600 and thus it may result in a dry air DA; (iii) the dry air DA may pass through the condenser and then may be re-heated to be fed to the data center 100 to be discharged out of the data center. The present disclosure is not limited thereto. In place of the dehumidifier 600, various types of dehumidifiers with the same function as or similar function to that of the dehumidifier 600 may be considered.

The re-heater 700 may use the hot water HW from the air to water heat pump 200 as a heat source to heat super-cool air CA2 from the data center 100 after the humidifying step. Thus, non-super cool air CA3 at the reference temperature (for example, 16 to 24° C.) may be acquired. Thus, the hot water HW from the air to water heat pump 200 may transfer the heat to the super-cool air CA2 in the re-heater 700 to be changed to the cool water CW2 which may be discharged out of the re-heater 700. As used herein, the super-cool air CA2 may refer to a cool air with a temperature below the reference temperature (for example, 16 to 24° C.).

The re-heater 700 may be activated after the dehumidifier 600 is activated. Specifically, after the dehumidifier 600 is activated, a temperature of an air in the data center 100 may fall below the reference temperature (for example, 16 to 24° C.). At this time, the re-heater 700 may be activated. However, after the dehumidifier 600 is activated, a temperature of an air in the data center 100 may remain in a range of the reference temperature (for example, 16 to 24° C.). At this time, the re-heater 700 may not be activated.

The re-heater 700 may or not have a further heating apparatus (not shown). Specifically, when the super-cool air CA2 is heated to a sufficiently high temperature using the hot water HW as a heat source, the re-heater 700 may not have the further heating apparatus or may not activate the heating apparatus if any. Even when the re-heater 700 has and activate the heating apparatus, the heating apparatus may advantageously consume a less power for evaporation of the further cool water CW3 because the hot water HW has the temperature of 50 to 90° C. considerably higher than a reference temperature in the data center 100, for example, 16 to 24° C. This may lead to energy save.

In the process of FIG. 3, the present of the re-heater 700 may save the power energy to be supplied to the air to water heat pump 200 in order to re-heat the air in the data center 100.

Further, the air to water heat pump 200 and the dehumidifier 600 and the re-heater 700 may be individual. Alternatively, the air to water heat pump 200 and the dehumidifier 600 and the re-heater 700 may be integrated into a single apparatus.

Although in FIG. 3, a single server rack 110 corresponds to a single air to water heat pump 200, a single dehumidifier 600, a single re-heater 700 and a single controller 400, the present disclosure is not limited thereto. A relationship between the numbers of the air to water heat pumps 200, dehumidifiers 600, re-heaters 700, and controllers 400 and the number of server racks 110 may vary based on the capacity of the air to water heat pumps 200, and dehumidifiers 600, and re-heaters 700 and the heat dissipation of the server rack 110.

Figure 4:
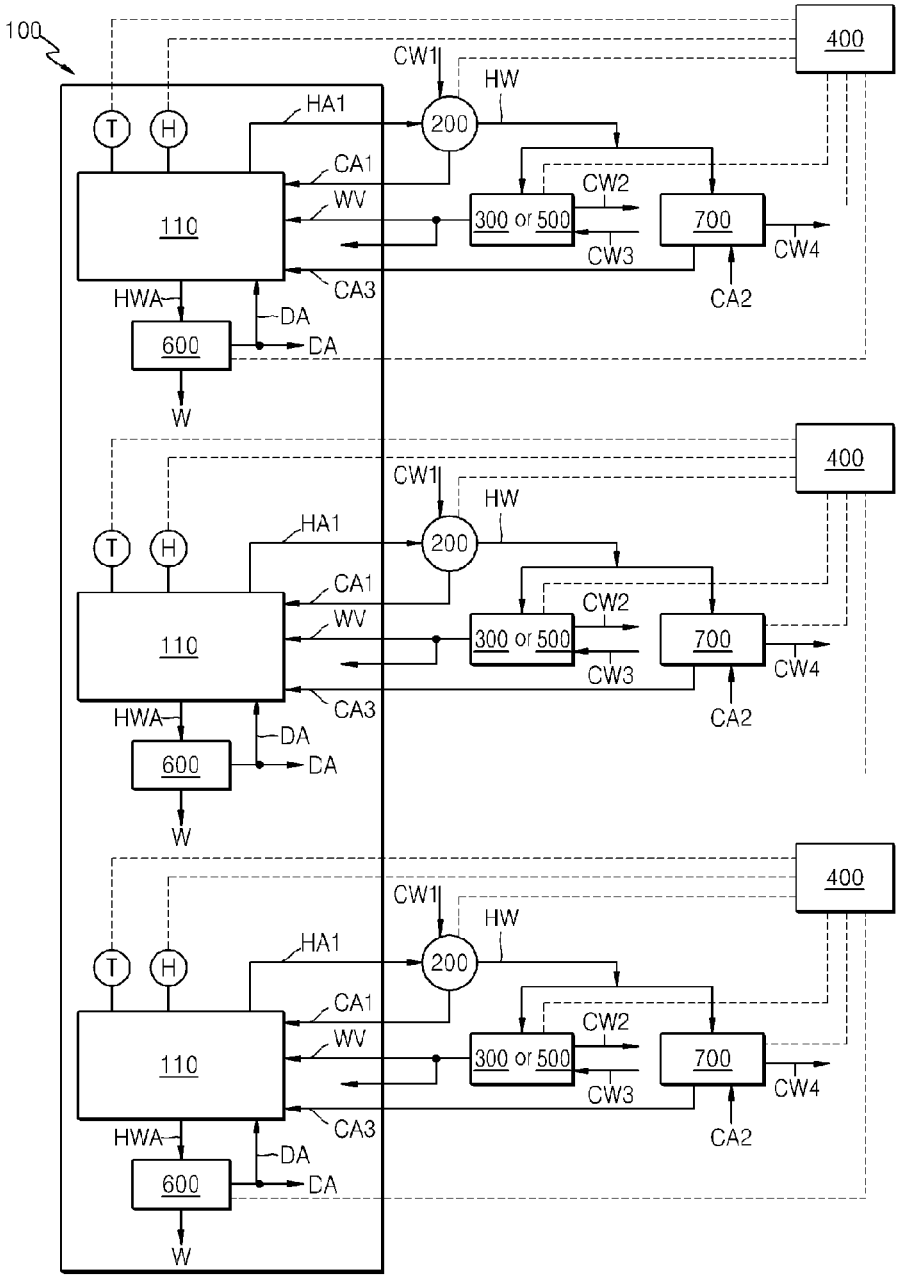
FIG. 4 shows a process circuit diagram for describing a waste-heat recycling method in a heat-dissipation facility in accordance with a fourth embodiment of the present disclosure.

FIG. 4 shows a process circuit diagram for describing a waste-heat recycling method in a heat-dissipation facility in accordance with a fourth embodiment of the present disclosure.

The waste-heat recycling method in a heat-dissipation facility in accordance with the fourth embodiment of the present disclosure may be a combination between the waste-heat recycling methods in accordance with the first and third embodiments or a combination between the waste-heat recycling methods in accordance with the second and third embodiments. The server rack 110, the air to water heat pump 200 and the controller 400 may have the same configurations between the first and second and third embodiments.

Referring to FIG. 4, plural server racks 110 in the data center 100 may dissipate the hot air HA1 containing a waste heat.

In the FIG. 4, (a) (i) the hot water HW from the air to water heat pump 200 is fed to the humidifying chamber 300 to evaporate the hot water to form a hot vapor WV to be used for humidifying the air in the data center 100 or (ii) using the hot water HW as a heat source, a further cool water CW3 fed to the humidifier 500 is evaporated to form a hot vapor WV to be used for humidifying the air in the data center 100; and (b) using the hot water HW as a heat source, a super-cool air CA2 fed to the re-heater 700 is heated to form a cool air CA3 to be used for re-heating the air in the data center 100. Correspondingly, (a) (i) the hot water HW from the air to water heat pump 200 may be fed to the humidifying chamber 300 where the same is evaporated to be changed to the hot vapor WV to be used for humidifying the air in the data center 100 or (ii) the hot water HW from the air to water heat pump 200 may be fed to the humidifier 500 where the same transfers a heat a further cool water CW3 fed to the humidifier 500 and then is changed to the cool water CW2 which, in turn, is charged out of the humidifier 500; at the same time, or subsequently, (b) the hot water HW may transfer a heat to the super-cool air CA2 fed to the re-heater 700 and then is changed to the cool water CW4 which, in turn, is charged out of re-heater 700.

In the process of FIG. 4, the humidifying chamber 300 and the humidifier 500 may be used in an alternative manner.

When the process of FIG. 4 uses the humidifying chamber 300, the humidifying chamber 300 and the re-heater 700 may be activated concurrently or sequentially. Further, in this case, the air to water heat pump 200, the humidifying chamber 300 and the re-heater 700 may be individual or may be integrated in to a single apparatus.

Further, when the process of FIG. 4 uses the humidifying chamber 300 acing as a humidifier, a separate humidifier may not be required in the data center 100, thereby to save the installation and maintenance costs of the humidifier.

When the process of FIG. 4 uses the humidifier 500, the humidifier 500, the dehumidifier 600 and the re-heater 700 may be activated concurrently or sequentially. Further, in this case, the air to water heat pump 200, the humidifier 500, the dehumidifier 600 and the re-heater 700 may be individual or may be integrated in to a single apparatus.

Further, the addition of the humidifier 300 into the process of FIG. 4 may lead to a save of the installation and maintenance costs of the humidifier because of the hot water HW being used as a partial heat source.

The fact that the process of FIG. 4 uses the re-heater 700 may allow the power energy save to the air to water heat pump 200 for re-heating the air in the data center 100.

Although in FIG. 4, a single server rack 110 corresponds to a single air to water heat pump 200, a single humidifying chamber 300 or a single humidifier 500, a single dehumidifier 600 and a single re-heater 700 and a single controller 400, the present disclosure is not limited thereto. The relationship between the number of server racks 110 and numbers of the air to water heat pumps 200, humidifying chambers 300, humidifiers 500, dehumidifiers 600, re-heaters 700 and controllers 400 may vary depending on the capacities of the water heat pumps 200, humidifying chambers 300, humidifiers 500, dehumidifiers 600, and re-heaters 700 and the heat dissipation of the server rack 110.

The processes as shown in FIG. 1 to FIG. 4 respectively may recycle a waste heat from the data center 100 to humidify and re-heat the air in the data center 100 for constant temperature and humidity. This may lead to a power save needed to maintain the data center at a proper and constant temperature and humidity.

The above description is not to be taken in a limiting sense, but is made merely for the purpose of describing the general principles of exemplary embodiments, and many additional embodiments of this disclosure are possible. It is understood that no limitation of the scope of the disclosure is thereby intended. The scope of the disclosure should be determined with reference to the Claims. Reference throughout this specification to "one embodiment," "an embodiment," or similar language means that a particular feature, structure, or characteristic that is described in connection with the embodiment is included in at least one embodiment of the present disclosure. Thus, appearances of the phrases "in one embodiment," "In an embodiment," and similar language throughout this specification may, but do not necessarily, all refer to the same embodiment.

What is claimed is:

1. A method for recycling waste-heat from a heat-dissipation facility, the method comprising:

(a) collecting hot waste air generated in the heat-dissipation facility (b) changing the hot waste air to cool air to change cool water to hot water;

(c) feeding the cool air to the heat-dissipation facility to cool air in the heat-dissipation facility;

(d) increasing a humidity in the heat-dissipation facility using the hot water;

(e) re-heating air in in the heat-dissipation facility using the hot water; and (f) removing moisture from humid air in the heat-dissipation facility to lower a humidity in the heat-dissipation facility, wherein the (e) operation follows the (f) operation.

2. The method of claim 1, therein the (a) to (c) operations are executed using an air to water heat pump.

3. The method of claim 1, therein the (d) operation includes:

evaporating the hot water to form a hot vapor; and feeding the hot vapor to the heat-dissipation facility.

4. The method of claim 3, wherein the (d) operation is executed using a humidifying chamber having a fan.

5. The method of claim 1, therein the (d) operation includes:

evaporating a further cool water using the hot water as a heat source to form a hot vapor; and feeding the hot vapor to the heat-dissipation facility.

6. The method of claim 5, wherein the (d) operation is executed using a humidifier having a fan.

7. The method of claim 1, wherein the (e) operation includes: transferring a heat from the hot water as a heat source to super-cool air to form non-super cool air, wherein the super-cool air is acquired from the heat-dissipation facility after the (f) operation; and feeding the non-super cool air to the heat-dissipation facility.

8. The method of claim 1, wherein the (a) to (f) operations are executed using individual apparatuses; or at least two of the (a) to (f) operations are executed in a single apparatus.

9. The method of claim 1, wherein the heat-dissipation facility is a data center, a semiconductor manufacturing factory, an electronics or electrics manufacturing factory, a precision machining factory, a secondary batter manufacturing factory, a secondary batter assembly factory, or a laboratory or hospital with measurement and/or analysis instruments.

* * * * *